US006446752B2

(12) United States Patent
Philippe

(10) Patent No.: US 6,446,752 B2
(45) Date of Patent: Sep. 10, 2002

(54) SCAFFOLDING

(76) Inventor: Michel J. Philippe, 2743 Dunning Road, Sarsfield (CA), K0A 3E0

( * ) Notice: Subject to any disclaimer, the term of this patent is extended or adjusted under 35 U.S.C. 154(b) by 0 days.

(21) Appl. No.: 09/896,288

(22) Filed: Jun. 29, 2001

(30) Foreign Application Priority Data

Jul. 6, 2000 (CA) ..... 2313513

(51) Int. Cl.[7] ..... E04G 3/00; E04G 3/10; A47G 29/02

(52) U.S. Cl. ..... 182/82; 182/224; 182/150; 248/241

(58) Field of Search ..... 182/82, 150, 224; 248/246, 241, 295.11, 235, 244, 245, 495; 52/127.2, 146, 149–152, 745.11

(56) References Cited

U.S. PATENT DOCUMENTS

| | | | | | |
|---|---|---|---|---|---|
| 4,068,427 | A | * | 1/1978 | Camardo | 52/127.2 |
| 4,819,900 | A | | 4/1989 | Funk | |
| 4,979,725 | A | * | 12/1990 | Hutchings, II et al. | 182/82 X |
| 5,307,899 | A | | 5/1994 | Lubinski | |
| 5,388,663 | A | | 2/1995 | Phillippe et al. | |
| 5,428,933 | A | | 7/1995 | Philippe | |
| 5,799,750 | A | | 9/1998 | Garcia | |
| 6,062,525 | A | * | 5/2000 | Lemire | 248/495 X |
| 6,247,273 | B1 | * | 6/2001 | Nickel | 52/127.2 |

FOREIGN PATENT DOCUMENTS

| | | | | |
|---|---|---|---|---|
| FR | 2572448 | * | 5/1986 | 182/82 |
| GB | 2222430 | * | 3/1990 | 182/150 |
| NL | 91586 | | 7/1959 | |

* cited by examiner

*Primary Examiner*—Daniel P. Stodola
*Assistant Examiner*—Hugh B. Thompson
(74) *Attorney, Agent, or Firm*—Pendorf & Cutliff

(57) ABSTRACT

A bracing assembly for controlling the vertical orientation of an upright structure, the assembly comprising: an angle brace having first and second ends, the first end for attachment to a fixed point adjacent to the structure; and an adjustable connector for connecting the angle brace to the structure; the adjustable connector including a mounting member for attachment to the structure, a brace mount for attachment to the second end of the angle brace, and a mechanism for movably connecting the mounting member with the brace mount and selectively adjusting the position of the brace mount under load conditions and in a substantially vertical plane. The bracing assembly may form part of a walkway assembly to provide a vertically adjustable walkway from which cement may be poured into forms for making a concrete wall foundation.

7 Claims, 4 Drawing Sheets

SCAFFOLDING

The invention relates to assemblies which may be used in construction and repair. More particularly the invention relates to bracing, alignment or scaffolding assemblies which permit adjustment under load conditions.

Upright structures may be fences, walls, sides of buildings, etc. They may also be structures such as foam block walls or concrete wall forms for pouring concrete foundation walls or they may be vertical members in scaffold assemblies, such as walkway assemblies. When working on such structures or using such assemblies it is sometimes necessary to adjust the vertical orientation.

For example, when making concrete wall foundations, a walkway assembly is needed to provide a platform from which workers may pour in cement into the forms for the foundation. The forms may be plywood structures or hollow interlocking foam blocks. Such a walkway assembly is described in U.S. Pat. No. 5,388,663 herein incorporated by reference. After pouring the cement, there may be changes in the vertical orientation of the block structure defining the wall giving rise to a need for adjustment.

In U.S. Pat. No. 5,388,663, it is suggested to adjust the vertical orientation of the wall by means of clamps which join two lengths of lumber which together form a brace. However, in the realities of the construction site, for example in inclement weather, such adjustment is not easy. The clamp may jam because of spilled cement or dirt or because of the cold weather. Fine adjustment is difficult with such clamps. Further, the adjustment normally requires two workers, one worker to make the adjustment, and another to check the plumb line for vertical orientation.

Similar problems are encountered in other situations in which the vertical orientation of an upright structure needs adjustment.

It is an object of the invention to provide an improved bracing assembly which can be adjusted under load conditions.

SUMMARY OF THE INVENTION

According to one aspect of the present invention there is provided a bracing assembly for controlling the vertical orientation of an upright structure, the assembly comprising:

an angle brace having first and second ends, the first end for attachment to a fixed point adjacent to the structure;

and an adjustable connector for connecting the angle brace to the structure;

the adjustable connector including a mounting member for attachment to the structure, a brace mount for attachment to the second end of the angle brace, and a means for movably connecting the mounting member with the brace mount and selectively adjusting the position of the brace mount under load conditions and in a substantially vertical plane.

According to another aspect of the present invention there is provided a walkway assembly for use with a foam-block wall or a wall form and capable of providing support to the wall or wall form, a side of the wall or wall form comprising a workface, said assembly comprising:

(1) a plurality of vertical support posts for placing adjacent to the workface;

(2) a walkway support bracket mounted on each post, each bracket having a horizontal walkway lumber support bar upon which walkway lumber may be placed to span the space between adjacent brackets;

(3) at least one angle brace for each of said vertical support posts, the angle brace having a first end for attachment to a fixed point adjacent the workface and a second end; and (4) an adjustable connector for each of said angle braces for connecting the angle brace to a support post, wherein the adjustable connector includes a mounting member for attachment to the support post, a brace mount for attachment to the second end of the angle brace, and a means for movably connecting the mounting member with the brace mount and selectively adjusting the position of the brace mount under load conditions and in a substantially vertical plane.

The brace assembly usually provides support to the upright structure, as well as adjustment of the vertical orientation. At the first end, the angle brace would be attached to the ground or other suitable fixed surface. For this purpose, the angle brace may conveniently be provided with flanges rotatably mounted at the first end to secure the brace to the ground whilst allowing angular movement of the brace. The first end of the angle brace would normally be secured to the ground, however, it is only necessary that the first end of the brace is secured in such a way that angular variation in the position of the brace by raising or lowering the height of the second end, adjusts the vertical orientation of the upright structure. It will be seen that the angle brace thus represents one side of an imaginary triangle of which the other two sides may be considered to be formed by the upright structure and the ground. Thus when the adjustable connector changes the angle made by the angle brace to the ground, the vertical orientation of the upright structure is also changed. The angle brace may also be used in an orientation in which the first end is attached to the workface and the adjustable connector is attached to the ground so that adjustment of the means for movably connecting the mounting member with the brace mount in a substantially horizontal plane adjusts the vertical orientation of the workface.

The angle braces are preferably provided with a telescopic or adjustable length. For example, preferably the brace is formed of three cooperating parts including two outside parts which are slidable within a sheath-like middle part so that the length may be roughly adjusted before attachment to the upright structure. Such length adjustment allows flexibility of placement at the work site.

The brace assembly may be positioned at any angle which permits adjustment of the vertical orientation. When the first end is attached to the ground, usually angles of from 30° to the horizontal to 60° to the horizontal, would be suitable and angles of about 45° to the horizontal would normally be most suitable.

In a preferred embodiment the brace assembly is part of a walkway assembly such as the assembly described in U.S. Pat. No. 5,388,663 which is suitable for accessing different wall heights and pouring concrete walls. In that assembly vertical support posts are provided by two-by-four lumber pieces which are notched on one side (the side adjacent the workface), with a shallow notch which is intended to receive a fastening ring. This ring may be rectangular and dimensioned to just slide down the vertical posts. At the notch, one side of the ring is dropped in, allowing a space to develop on the other side of the ring. In that assembly, walkway brackets are provided with an engaging leg that fits between the post and the ring. The brackets also have a horizontal bar (to serve as a walkway lumber support), a downwardly angled brace, and a post-contacting thrusting flange at the lower end of the brace. By hooking the walkway bracket engaging leg onto the fastening ring and placing the thrusting flange against the support post beneath this connection, a sturdy support bar is formed that can carry walkway lumber to form a walkway. The brace assembly according to the invention can then be attached to the workface of the wall forms, or preferably attached directly to the vertical support posts to provide-the vertical support posts with lateral support. As long as the vertical support posts are in contact with the workface, adjusting the vertical orientation of the posts will also adjust the vertical orientation of the workface.

The vertical support posts may also be of any suitable material strong enough to provide support such as metal (steel or aluminum for example), plastic or a composite material, so that they can be more conveniently transported from site to site and more readily re-used.

In the case of metal vertical support posts, the posts may have regularly spaced holes for connection of the brackets by pins or bolts and for convenient adjustment of the working height of the brackets. The posts may also have flanges at the bottom with holes so that the posts may be secured to the ground, such as by nailing. The posts may be stackable or they may be a combination of pieces which may be assembled to increase the height of the walkway. The posts may be provided with slots along a side thereof intended to be in contact with the workface. Such slots would then permit the posts to be attached to the workface while allowing vertical movement of the workface in relation to the posts (such as during settling, or vertical compression, of a foam-form wall as it is filled with concrete in formation of a foundation wall).

It is preferred that "hat-shaped" wall brackets are placed around the vertical support posts. Flanges formed on the wall brackets may then be fastened to the workface or wall to provide additional vertical support. Since these brackets are not fastened to the posts they allow the wall to subside, or compress vertically (a common occurrence with foam-form walls), without impairing the integrity of the support.

In the case of foam-form walls, the wall brackets may be fastened to steel reinforcement or other solid stiffeners that are incorporated into the wall. This may be done by using nails, self-tapping screws etc.

Normally the walkway assembly would have at least two brace assemblies to cooperate with at least two corresponding vertical support posts. If greater height is required, then two or more brace assemblies may be used for each vertical support post.

The adjustable connector includes means for movably connecting the mounting member with the brace mount. This movable connecting means may be a hydraulically operated system or a motorized system. In a preferred embodiment, the adjustable connector comprises a mounting member having two flanges perpendicular to its length. A bolt passes between a hole in each of the two flanges. The bolt is freely rotatable in the holes of the flanges and has a threaded portion at least encompassing a portion of the bolt which lies between the two flanges. The brace mount would be pivotally connected to the second end of the angle brace. The brace mount has a thread to receive and cooperate with the threaded portion of the bolt thus providing means for movably connecting the mounting member and the brace mount. Rotation of the bolt causes the brace mount to travel along the threaded portion, thus changing the vertical orientation of the upright structure. Thus the vertical movement of the brace mount causes the second end to move in an arc centred on the point of attachment of the first end. The arcuate movement of the second end means that the angle of intersection of the second end with the axis of the bolt varies with the movement of the brace mount. In this preferred embodiment, the threaded portion of the bolt provides for continuous adjustment to any desired position between a maximum and a minimum represented by the extremities of the threaded portion between the flanges.

Preferably the bolt will extend considerably beyond the flanges, at least at one end thereof, to allow convenient rotation. For example, it is preferred that the bolt extends above the level of the walkway so that a workman may easily rotate the bolt from the walkway by means such as a cordless drill. If the bolt also extends downwardly beyond the other flange, the bolt could conveniently be rotated from below the walkway. It will be seen that in this arrangement, it is possible for a single workman to adjust the vertical orientation of the workface. Further, since the working portion of the means of adjustment, the threaded portion of the bolt, is below the walkway, it has protection from dirt and accidental spills which may descend from the walkway. The flanges at either end of the mounting member may also be shaped and sized to give added protection to the threaded portion of the bolt reducing the risk of the bolt device becoming jammed.

The mounting member is preferably provided with a slot along its length to receive the body of a pin or bolt attached to the brace mount. The pin or bolt may be provided with a nut to further secure the brace mount to the mounting member and provide additional strength. The brace mount may be conveniently formed by welding a nut, or a pair of nuts, to a suitable joint which may be pivotally connected to the second end of the angle brace by a pin or bolt.

The mounting member may be mounted directly onto the posts by means of pins or bolts passing through holes corresponding to holes in the posts. The posts may then have slots or channels to accommodate any bolt or pin which extends from the brace mount beyond the slot of the mounting member. The mounting member may also be integral with the post, such as by welding.

The brace assembly thus permits adjustment of the vertical orientation of the upright structure. In cases where the mounting member is attached directly to the workface, the vertical orientation of the workface may be adjusted during work on the workface. In the case where the upright structure is the vertical support post of a walkway assembly, it adjusts the vertical orientation of the posts after the walkway assembly has been erected and during use of the walkway. Also it permits adjustment without need to interrupt the workflow, that is, a workman using the walkway may make adjustments on his own and without needing to get off the walkway.

SUMMARY OF THE FIGURES

The invention will be further described with reference to the accompanying drawings in which.

DESCRIPTION OF THE PREFERRED EMBODIMENTS

Figure 1:
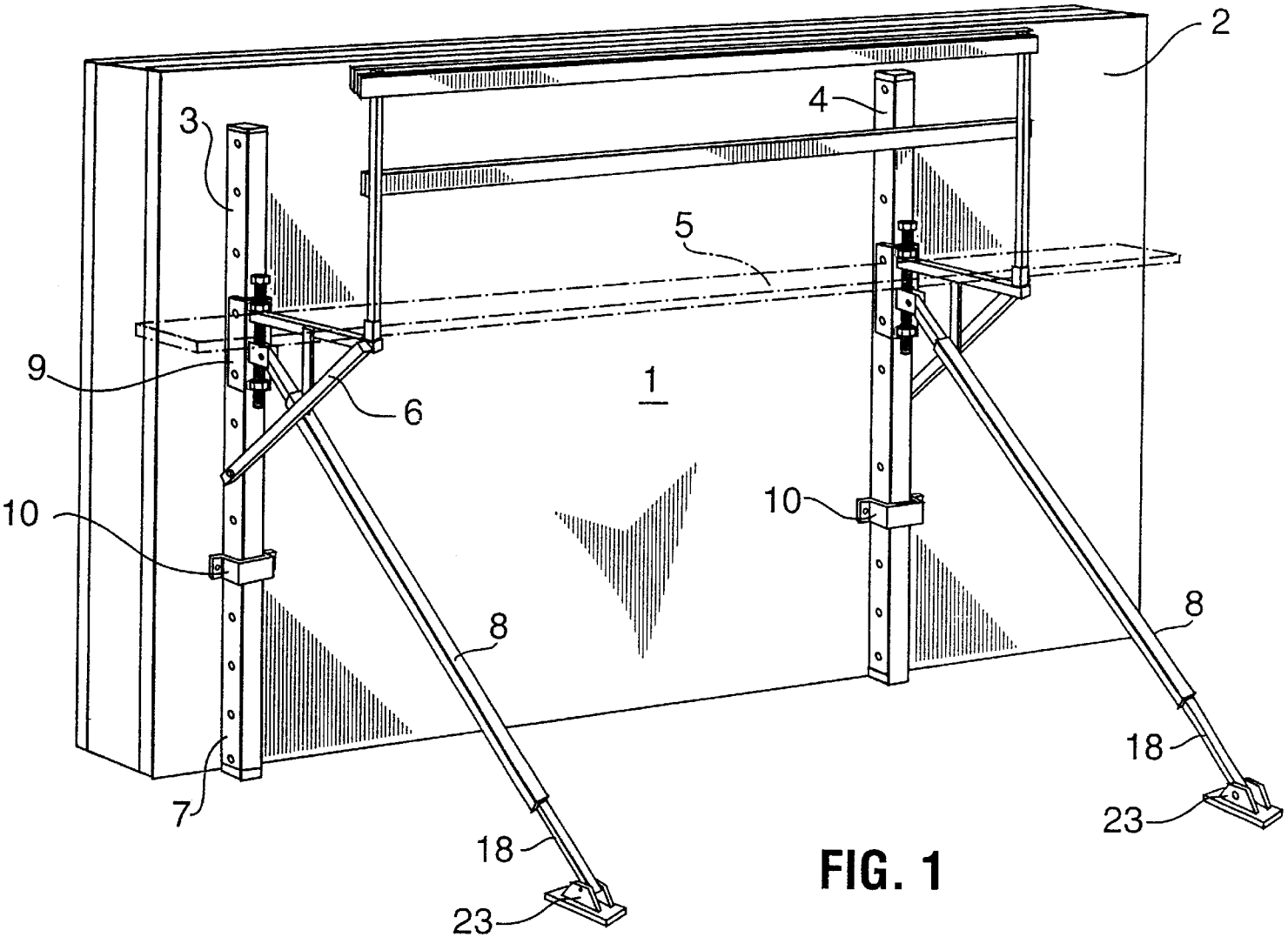
FIG. 1 is a perspective view of a preferred walkway assembly embodiment placed against a concrete wall form.

FIG. 1 shows a workface 1 which is part of a form 2. A walkway assembly comprises units indicated by numerals 3 and 4 and is placed against or adjacent the workface 1. Walkway lumber 5, when placed in position, then provides a walking surface.

Each unit 3 or 4 comprises: a walkway bracket 6, to support the walkway lumber 5; a vertical support post 7 to support bracket 6; an angle brace 8 to support the post 7; adjustable connector 9 for adjustable connection of brace 8 to post 7; and preferably a hat-shaped bracket 10.

The workface 1 may be part of a form 2 for a concrete wall. The form would then provide a hollow space into which the cement or concrete may be poured to form the wall. The form material may be any suitable material such as lumber, or conveniently it may be interlocking foam blocks. The workface may also be some other structure which may require adjustment of its vertical orientation during operation.

The walkway assembly comprises a plurality of structures such as those indicated as 3 and 4. At least two such structures would normally be needed to support the lumber 5 to provide a walking surface.

Figure 2:
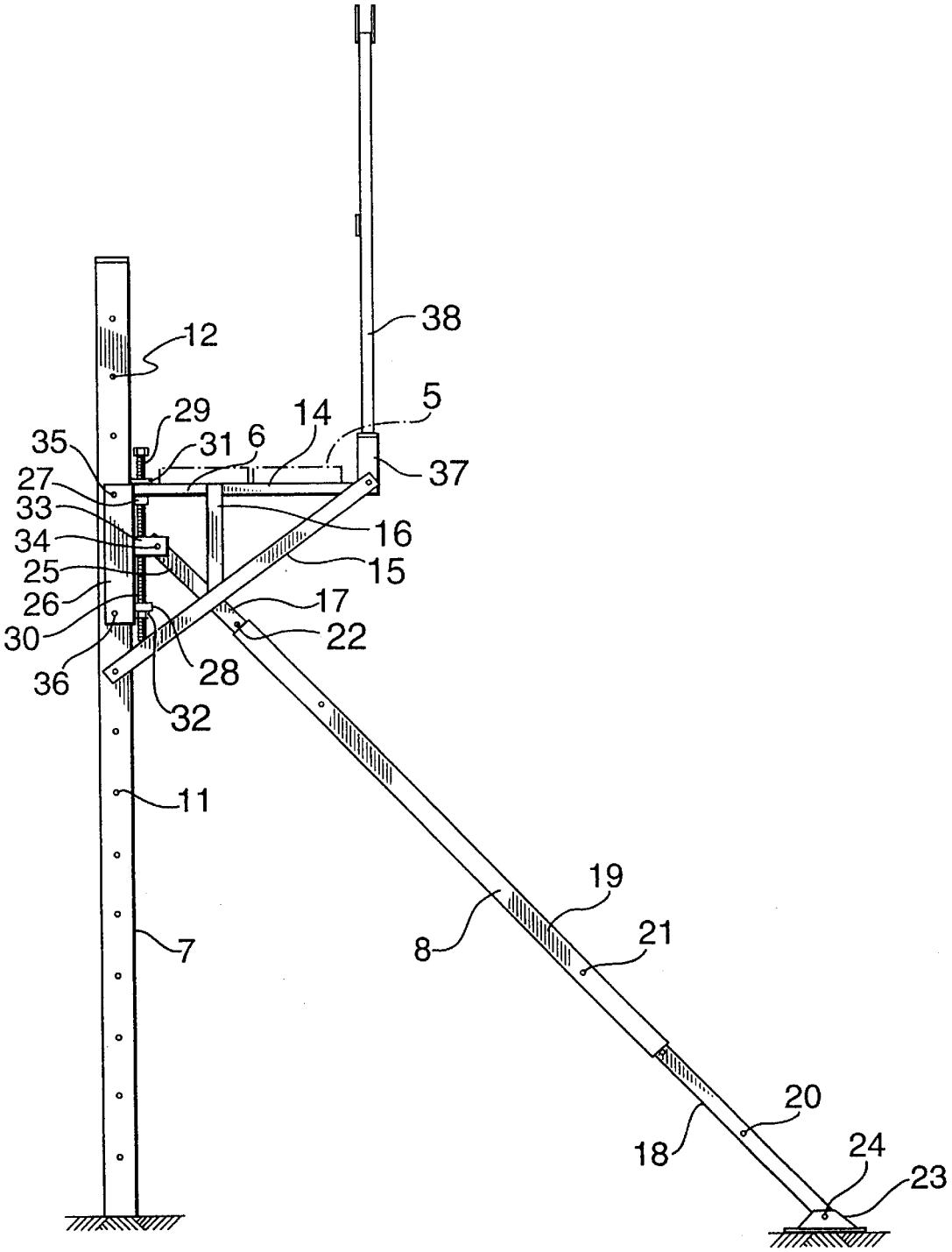
FIG. 2 is a more detailed side view of a part of the assembly shown in the FIG. 1.

FIG. 2 shows a unit such as unit 3 in more detail. Vertical support post 7 may be of any suitable structural material but is conveniently made of metal such as steel, or preferably aluminum, for easy transportation and re-use. It may also be formed from lumber such as two-by-four lumber which may be available on a work site. Preferably, the post 7 has regularly spaced holes such as 11 and 12 for easy adjustment of the height of the walkway when the assembly is erected.

The walkway bracket 6 has a lumber support bar 14 which is preferably strengthened by brace elements 15 and 16. Bar 14 supports the walkway lumber or other material, such as aluminum, suitable for a walkway. Preferably, lumber support bar 14 allows for at least two scaffold grade planks 5. Brace elements 15 and 16 are to provide strength to support bar 14. Other structural variations are possible.

Angle brace 8 provides support for vertical support post 7. Angle brace 8 is preferably of a telescopic design to permit adjustment of its length during on-site assembly. A preferred design includes two members 17 and 18 slidable within a sheath member 19. Each of the members 17, 18 and 19 may have regularly spaced corresponding holes 20, 21 and 22 which can accept a pin or bolt to lock them in place. One end, a first end, of the angle brace 8 is for attachment to a fixed point and therefore would usually be a ground-engaging end and preferably has a ground-engaging member 23 pivotally attached by way of a pin or bolt 24 to the lower member 18 of the angle brace. Ground-engaging member 23 preferably has flanges (not shown) with holes for easy securing to the ground, such as by nails or spikes. The first end may also be affixed by any other suitable means. It will be understood that the first end of angle brace 8 may be secured to any suitable surface which provides a base adjacent the workface provided it is sufficient to allow angle brace 8 to support the relevant upright structure such as vertical support post 7.

The other end 25 of angle-brace 8 is a second end or workface end. End 25 is adjustably connected to the vertical support post 7. The end 25 is mounted so as to permit movement in a substantially vertical plane, preferably upward and downward movement with respect to the ground and support post 7. Since the first end of the angle brace is secured, up and down movement of the second end, assisted by the pivotal attachment of the ground-engaging member 23, adjusts the vertical orientation of the post 7, and thus the workface, with which it is in contact.

The preferred adjustable connector 9 comprises a mounting member 26 which has two flanges 27 and 28 perpendicular to the length of the member 26. A bolt 29, having a threaded portion 30 is rotatably mounted to the mounting member 26 by means of holes in flanges 27 and 28. The bolt is held in position by nuts 31 and 32 so that it is free to rotate but does not move up or down. The threaded portion 30 of the bolt 29 engages a threaded portion of brace mount 33 which is pivotally attached at 34 to the second end of angle brace 8. Thus rotation of the bolt 29 forces the brace mount 33 to move up or down the length of the bolt, which in turn causes the second end 25 of angle brace 8 to move up and down, thus adjusting the vertical orientation of the vertical support post 7, to which end 25 is connected. Thus the threaded portion of bolt 29 in cooperation with the threaded portion of brace mount 33 provides means for movably connecting the mounting member 26 with brace mount 33.

Preferably the ends of the bolt 29 extend well beyond the flanges 27 and 28 for easy adjustment. For example, the top of the bolt 29 may extend above any lumber used for the walkway so that the bolt is easily accessed by a workman on the walkway by means of a power drill, wrench etc. Similarly, the bottom of bolt 29 may extend downwardly, for easy access by a workman below the walkway.

Flanges 27 and 28 may also be shaped to improve protection of the threaded portion of the bolt from dirt and spills.

It is not necessary that bolt 29 is threaded along its entire length, only that there is a threaded portion between the flanges 27 and 28 to allow adjustment of the angle brace 8. However, bolt 29 may also be threaded along its entire length and, since any threaded portions lying outside flanges 27 and 28 are not needed, they do not have to be protected. This is an advantage on a work site where equipment is subject to rough usage. Further, other moving parts such as brace mount 33 may be protected by being below the lumber of the walkway. Thus the working parts of the mechanism, the adjustable connector, may be protected.

In the preferred walkway assembly embodiment, the mounting member 26 is preferably adapted to be directly attached to the vertical support posts, for example by bolts or pins through holes 35 and 36 which are spaced to match the spacing of the holes of the vertical support post. The mounting member may also be connected to the walkway bracket 6 or be integral therewith to form conveniently a single component.

The walkway bracket 6 may have a fitted socket or rail support means 37 to receive and support a removable guard rail post 38.

Any of the pins which may be used for connection, such as for the holes in the post, the angle brace components, the mounting member and the pivots may have spring mechanisms. That is, they may have mechanisms which effectively snap-lock them in position when placed, until they are released. This facilitates assembly and disassembly of the walkway.

Figure 3:
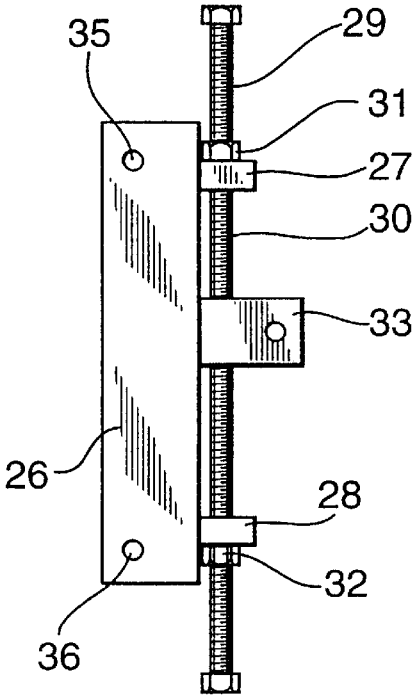
FIGS. 3, 4 and 5 are side, front and rear views respectively of a preferred adjustable connector.
Figure 4:
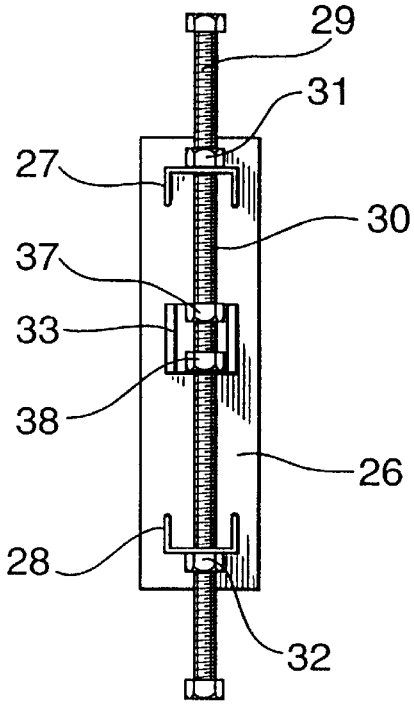
Figure 5:
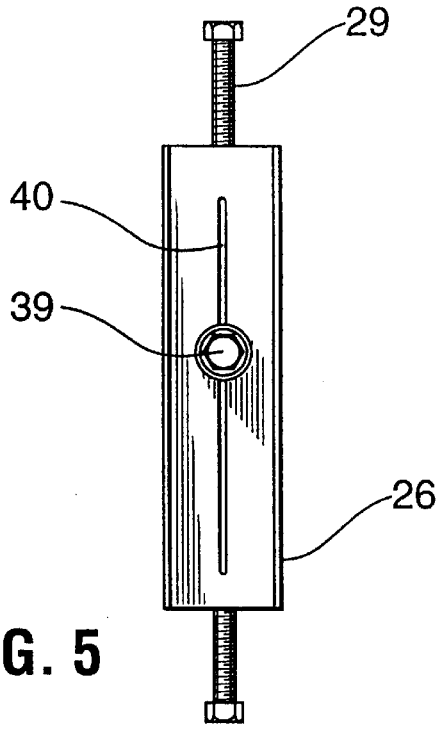

FIGS. 3, 4 and 5 show the preferred adjustable connector in more detail. Mounting member 26 has flanges 27 and 28 adjacent either end. Bolt 29, which passes though holes in flanges 27 and 28, is freely rotatable and is kept in place by nuts 31 and 32. The threaded portion 30 of bolt 29 engages the threaded brace mount 33 so that rotation of bolt 29 causes brace mount 33 to move along the length of threaded portion 30. The thread in brace mount 33 may be provided by nuts 37 and 38, integral therewith.

For added stability, as shown in FIG. 5, a bolt 39 may be connected to the brace mount 33 (not shown in FIG. 5) by way of a slot 40 in the mounting member 26.

Figure 6:
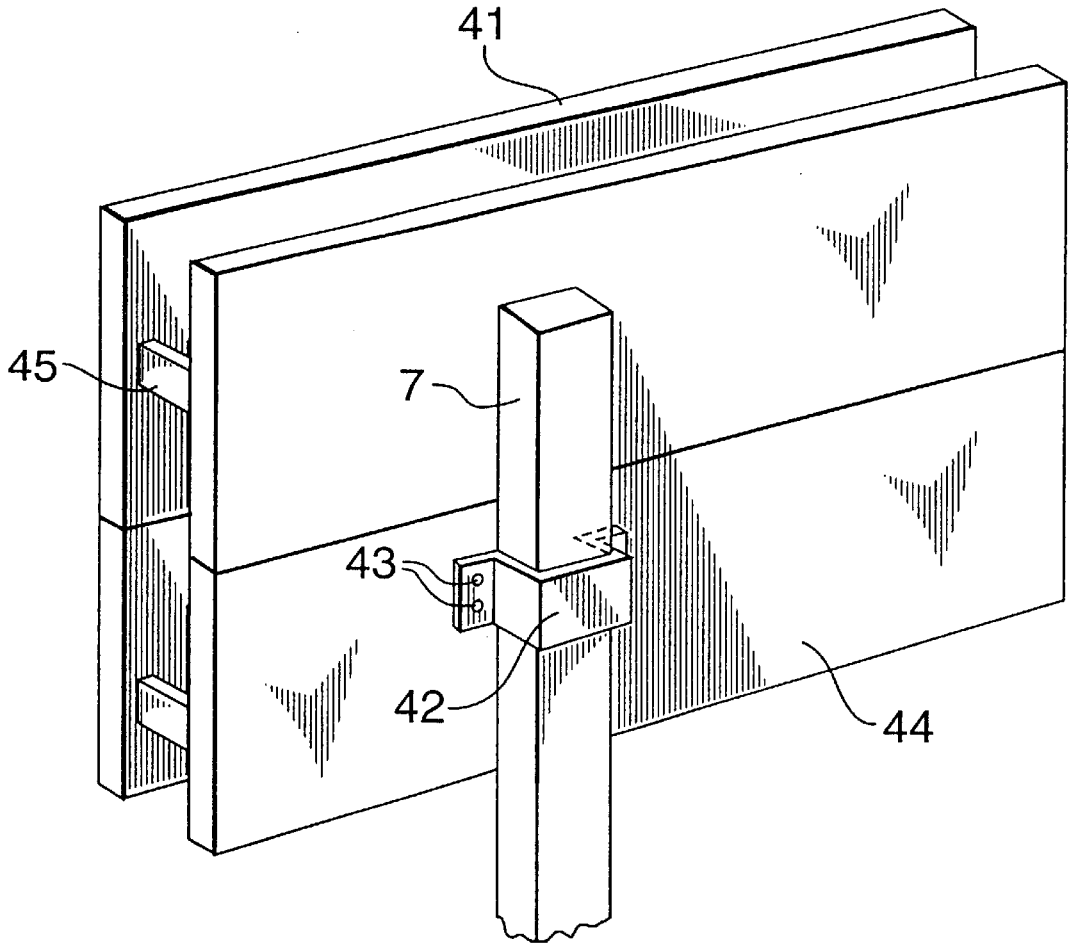
FIG. 6 is a face view of a foam form wall based on IntegraSpec™ type blocks, suitable for use with a walkway, against which a vertical support post has been fastened by a bracket.

When a foam-form wall 41 as shown in FIG. 6 is being constructed, the posts 7 may be retained in a vertical position against the wall by hat-shaped brackets 42. These brackets 42 should be fastened, as by self-tapping screws 43, to reinforcing (not shown) within the foam-form wall 41.

An example of a wall 41 particularly suited to this invention is the IntegraSpec™ wall produced by Phil-Insul Corporation of 2743 Dunning Rd., Sarsfield (Ottawa), Ontario, Canada. The block 44 provided by this company has flanges such as flange 45 imbedded within the foam, into which the screws 43 may engage. Other products may provide a flange attached to a rail that is laid between each course of blocks, or some equivalent structure.

Because the brackets 42 have a sliding fit around the posts 7, as the foam-form wall 41 is filled with concrete, it is free to settle. While the brackets 42 subside with the wall, they merely slide along the posts 7, continuing to provide lateral support.

The invention allows a kit comprising walkway brackets 6 incorporating adjustable connector 9, vertical support posts 7, angle braces 8 and optionally hat-shaped brackets 42.

From this a walkway can be temporarily constructed that can easily be disassembled for re-use of all its components.

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein as follows.

What is claimed is:

1. A bracing assembly for controlling the vertical orientation of an upright structure, the assembly comprising:

an angle brace having first and second ends, the first end for attachment to a fixed point adjacent to the structure;

an adjustable connector for connecting the angle brace to the structure;

the adjustable connector including a mounting member for attachment to the structure, a brace mount for attachment to the second end of the angle brace, and a means for movably connecting the mounting member with the brace mount and selectively adjusting positions of the brace mount under load conditions and in a substantially vertical plane relative to the mounting member; and the adjustable connector further comprises a bolt freely rotatably mounted at two ends of the mounting member and substantially vertical, the bolt having a threaded portion between the ends, and the brace mount pivotally attached to the second end of the angle brace and having a threaded portion to engage and cooperate with the threaded portion of the bolt, whereby rotation of the bolt moves the brace mount along the threaded portion of the bolt.

2. The bracing assembly according to claim 1 wherein said bracing assembly is adapted for controlling the vertical orientation of a post.

3. A walkway assembly for use with a foam-block wall or a wall form and capable of providing support to the wall or wall form, a side of the wall or wall form comprising a workface, said assembly comprising:

(i) a plurality of vertical support posts for placing adjacent to the workface;

(ii) a walkway support bracket mounted on each post, each bracket having a horizontal walkway lumber support bar upon which walkway lumber may be placed to span the space between adjacent brackets;

(iii) at least one angle brace for each of said vertical support posts, the angle brace having a first end for attachment to a fixed point adjacent the workface and a second end;

(iv) an adjustable connector for each of said angle braces for, connecting the angle brace to a support post, wherein the adjustable connector includes a mounting member for attachment to the support post, a brace mount for attachment to the second end of the angle brace, and a means for movably connecting the mounting member with the brace mount and selectively adjusting positions of the brace mount under load conditions and in a substantially vertical plane relative to the mounting member; and (v) the adjustable connector further comprises a bolt freely rotatably mounted at two ends of the mounting member and substantially vertical, the bolt having a threaded portion between the ends, and the brace mount pivotally attached to the second end of the angle brace and having a threaded portion to engage and cooperate with the threaded portion of the bolt, whereby rotation of the bolt moves the brace mount along the threaded portion of the bolt.

4. The walkway assembly according to claim 3 further comprising vertical support brackets placed around the support posts for sliding engagement therewith, said brackets for fastening to said workface.

5. The walkway assembly as in claim 3 wherein each walkway bracket comprises a rail support means to support a guard rail.

6. The walkway assembly according to claim 3 wherein each of the vertical support posts is provided with a means for a channel in the form of a notch or hole to receive a fastening ring, the assembly further comprising a fastening ring installed on each of said posts, each such ring being engaged with said notch or hole in the respective post, wherein each walkway bracket is being engaged with a respective fastening ring, the brackets having (i) an engaging leg by which they are engaged with a respective one of said fastening rings, (ii) a downwardly angled brace, (iii) a thrusting flange located at the lower end of the said downwardly angled brace and positioned to bear against the post beneath the fastening ring.

7. The walkway assembly according to claim 3 wherein the vertical support posts, the brackets and the angle braces are of aluminum.

* * * * *